United States Patent [19]

Salomon

[11] 4,160,555

[45] Jul. 10, 1979

[54] SAFETY BINDINGS FOR SKIS

[75] Inventor: Georges P. J. Salomon, Annecy, France

[73] Assignee: S.A. des Ets Francois Salomon & Fils, Annecy, France

[21] Appl. No.: 796,811

[22] Filed: May 13, 1977

[30] Foreign Application Priority Data

May 18, 1976 [FR] France ..... 76 14892

[51] Int. Cl.[2] ..... A63C 9/08

[52] U.S. Cl. ..... 280/612

[58] Field of Search ..... 280/612, 611, 613

[56] References Cited

U.S. PATENT DOCUMENTS

| | | | |
|---|---|---|---|
| 3,892,980 | 7/1975 | Anderson | 280/612 X |
| 3,907,316 | 9/1975 | Marker et al. | 280/612 |
| 3,919,563 | 11/1975 | Lautier et al. | 280/612 X |

FOREIGN PATENT DOCUMENTS

| | | | |
|---|---|---|---|
| 2519544 | 11/1975 | Fed. Rep. of Germany | 280/612 |

*Primary Examiner*—Joseph F. Peters, Jr.
*Assistant Examiner*—Milton L. Smith
*Attorney, Agent, or Firm*—Haseltine, Lake & Waters

[57] ABSTRACT

A ski safety binding has a ski boot clamping member on a ski and a means for locking the member. An electric release for the safety binding comprises means for detecting a force on the skier's leg and for producing a signal as a function of this force. The release also comprises a threshold circuit and means electrically controlling the locking means. The latter is operated to release the locking mechanism when the threshold circuit emits an output signal. A circuit for increasingly attenuating the output signal the shorter its duration is interposed between the detecting means and the threshold circuit.

5 Claims, 9 Drawing Figures

SAFETY BINDINGS FOR SKIS

The present invention relates to a ski safety binding with electrical release.

Ski safety bindings are already known permitting automatic release of the boot of a skier in the case where too high a force capable of causing serious lesions to his leg is exerted on the latter. Generally, the release of such bindings is effected mechanically thanks to one or more springs which are controlled as a function of the force required to obtain release of the boot. These bindings are not perfect since the release is only effected as a function of the urging force and in no case take account of the duration of the latter, which can be dangerous.

It is known that a skier's leg can accept a violent force if it is brief. The limiting value of force acceptable by a skier's leg decreases as a function of the time during which this effort is applied and follows essentially a hyperbolic function.

Electric release of ski safety bindings is already known in which it is attempted to take account of this time factor. Generally, there is used in the bindings an integrating circuit forming the integration of force as a function of time and the value of this integration is compared with a threshold determined by the skier. The signal to release the binding is only emitted if the integration exceeds the predetermined threshold.

Bindings of this kind have the inconvenience of necessitating the use of relatively complex electronic circuits due to the presence of integrating circuits.

The present invention seeks to overcome this inconvenience by providing a binding of this kind with a particularly simple electrical control circuit.

Accordingly, this safety binding with electric release for a ski comprises at least one boot clamping member, locking means for this clamping member and a release control circuit acting on the locking means and comprising means for detecting a force exercised on a skier's leg and for producing an electric signal which is a function of this force, a signal amplifier, a threshold circuit and means for electrically controlling the locking means so as to effect release of the binding when the threshold circuit emits an output signal, there being between the amplifying circuit and the threshold circuit, a circuit increasingly attenuating the amplified signal the shorter its duration.

In the safety binding according to the invention the attenuating circuit serves as a waveform correction circuit for attenuating in variable manner the signal corresponding to the force and compares the attenuated signal to a constant threshold value corresponding to the maximum value of the force which can support the leg in static condition.

The safety binding according to the invention can be formed very simply since the waveform correcting circuit, functioning as an attenuator, can be constituted by a simple filter with active or passive elements.

The present invention will now be described by way of example with reference to the accompanying drawings in which.

Figure 1:
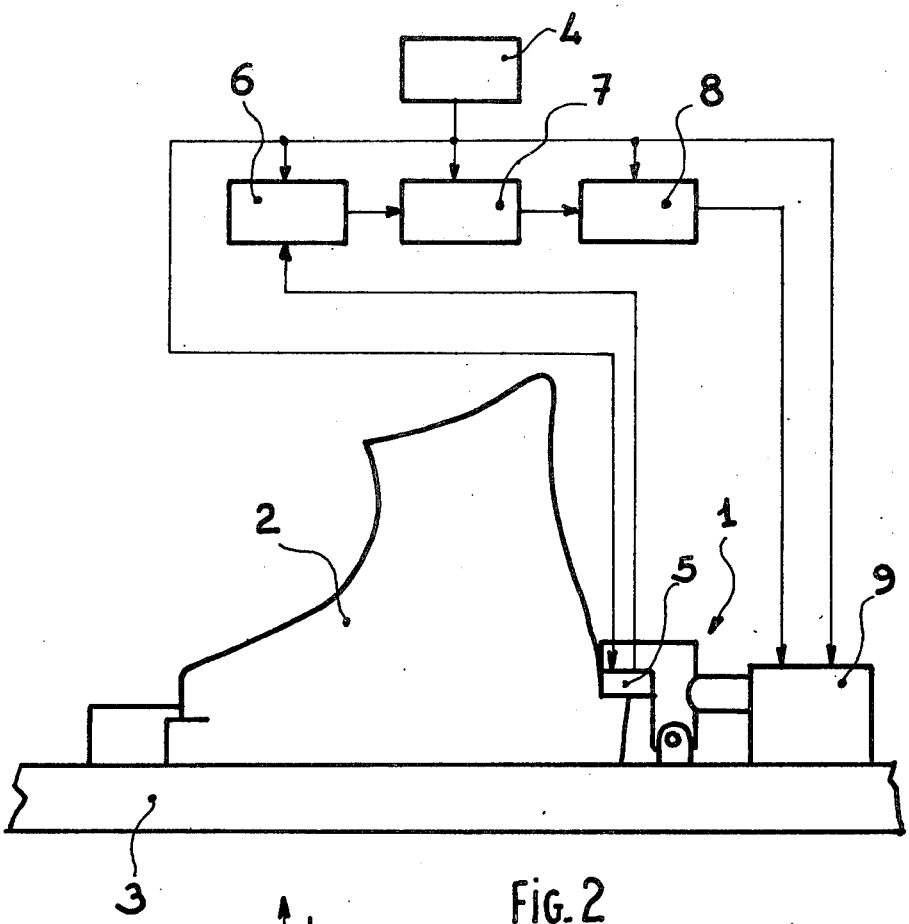
FIG. 1 is an electrical circuit diagram of a control circuit for safety binding according to the invention.

In FIG. 1 is shown schematically a safety binding 1 ensuring the clamping of a boot 2 onto a ski 3. The binding 1 can be of any known type; it comprises a movable member which normally ensures the clamping of the boot 2 on the ski and means for locking this member. These locking means are controlled in a known manner to release the clamping member and to free the boot 2 when a force of sufficient significance is exerted on the leg of the skier, that is to say on the boot 2.

The binding 1 comprises, however, an electrical release control circuit which acts on the locking means. This circuit essentially comprises a chain of electrical stages fed by a supply 4. The chain comprises one or more pick-ups 5 detecting the force exerted on the boot 2. The binding can comprises several pick-ups disposed before and behind or even under the boot, to detect all the forces exerted on the boot. In the embodiment of FIG. 1, the pick-up or pick-ups 5 are positioned at the heel of the boot. These pick-ups 5 are connected to an amplifier 6 whose output is connected to a waveform correction circuit 7 which will be described later. The waveform correction circuit 7 is itself connected to a threshold circuit 8 whose output is connected to a stage 9 connected by mechanical locking means to release the latter to unfasten the binding. The unfastening can be obtained by different means, notably electromagnetic and pyrotechnical means.

The pick-ups 5 and the amplifier 6 can be used in known circuits. The pick-up 5 can be of a magnetoresistance type, a piezo-electric type, a variable resistance type, a capacity or inductance type, or a thermoelectric type etc. The pick-ups 5 are positioned judicially in a manner to measure the various signals transmitted by the skier during use of the ski.

The amplifier 6 is embodied in a form of integrating circuit and if necessary one can position a rectifier following this amplifier in the measuring chain or circuit.

Figure 2:
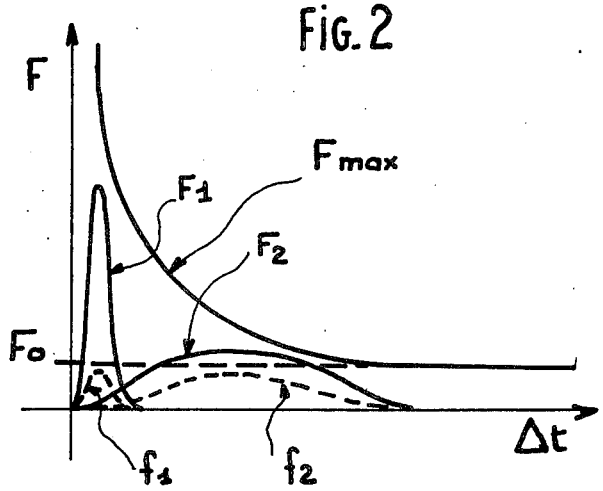
FIG. 2 is a graph showing the variation of the maximum force bearable by the leg of a skier as a function of time, and also various forms of the variation of the force and the electric signals attenuated correspondingly.

The waveform correction circuit 7, to which is fed the amplified signal originating from the amplifier 6, is to take into account a time factor, that is to say, of the time during which a force is applied to the leg of the skier. In fact, the leg can bear a violent force on condition that this is for a short time, as the leg cannot bear a great force if its duration is prolonged. The curve in FIG. 2 shows the variation of the maximum force supportable by the leg as a function of the time during which it is applied. It can be seen from the curve in FIG. 2 that the value of the maximum force F supportable by the leg decreases as a function of time, according to an approximately hyperbolic function, towards a value FO which corresponds to the maximum value of the supportable force in a static condition.

Shown by full lines in FIG. 2 are two curves F1 and F2 giving the trend of the variation of the force in two known cases, the curve F1 being for the case of a strong force of brief duration and the curve F2 being for the case of a weak force but which has a longer duration. The first curve has a steep slope but the second curve has a very much smaller slope and is more rounded. In these two cases, the curves of the forces F1 and F2 are located below the limiting curve F maximum and thus these forces must not cause the release of the binding. This release must occur only if the force surpasses for any instant the force F maximum of the limiting curve.

In the same graph of FIG. 2 is shown schematically, in dashed lines, two forms of signal f1 and f2 supplied by the waveform correction circuit 7 and corresponding respectively to the mechanical forces F1 and F2. These signals have been attenuated in different proportions in such a way that their maximum amplitude is lower than a threshold corresponding to the threshold FO of the maximum force permissible in the static condition.

It can be understood in one sense that the principal function of the waveform correction circuit 7 is to transform the curve of the variation of the maximum force F maximum into the straight line FO equals a constant.

There will now be described various ways of making the waveform correction circuit 7.

Figure 3:
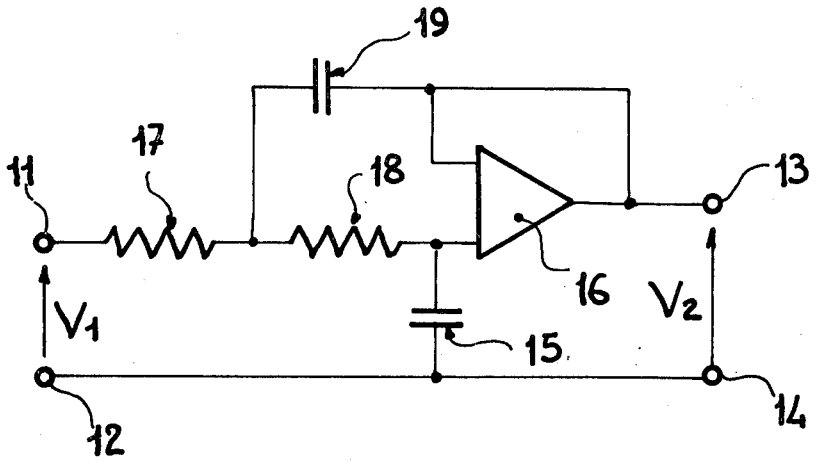
FIG. 3 is an electrical circuit diagram of a waveform correction stage comprising an attenuator.

In FIG. 3 is shown a waveform corrector comprising a low-pass filter of second order of active elements. This filter has two input terminals 11 and 12 between which is applied the measured amplified signal V, corresonding to the detected force. The attenuated signal $V_2$ emitted from this circuit appears between two output terminals 13 and 14. The terminals 12 and 14 are connected between them and by the intermediary of two resistances 17 and 18 connected in series. The connection point between these two resistances 17 and 18 is connected, via a condenser 19, by one lead to a second input of the amplifier 16 and by a second lead to the output of the amplifier 16 which is connected to the terminal 13. This low pass filter has a cut-off frequency fo determined by the formula in $$fo = \frac{1}{\lambda \pi R \sqrt{C1 \times C2}}$$

which R is the value of the two resistances 17 and 18, C1 is the value of the capacity of the condenser 19, and C2 is the value of the capacity of the condenser 15. As soon as the measured amplified signal V, has a lower frequency lower than the cut-off frequency fo, the output signal $V_2$ is equal to the input signal V, and one is then in the static condition. On the contrary, if the frequency of the signal V, is greater than the cut-off FO of the filter (in the case of a force F1 of great intensity and short duration) the output signal $V_2$ is attenuated in relation to the input signal $V_1$ following a sloping curve of 12 decibels per octave since the filter is of second order. The waveform correction circuit thus delivers to its output a signal which is more attenuated as its frequency is more elevated.

Figure 4:
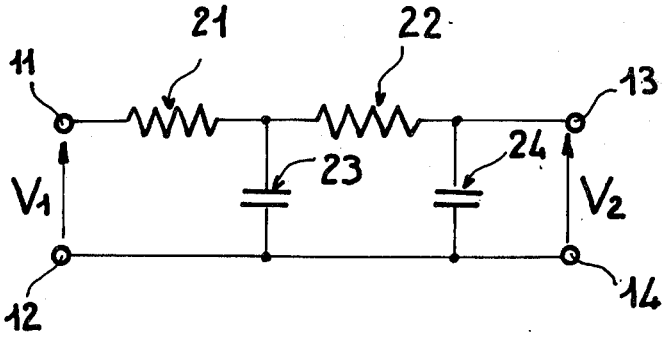
FIGS. 4, 5 and 6 are electrical circuit diagrams of other waveform correction circuits.

The low pass filter comprising the waveform corrector can also be constructed with the help of filter cells of the first passive order in cascade as is shown in FIG. 4. The filter shown in this figure comprises two resistances 21 and 22 connected in series between the terminals 11 and 13, and two shunted condensers 23 and 24. The condenser 23 is connected between the junction between the resistances 21 and 22, and the condenser 24 is connected in parallel across the terminals 13 and 14. This type of filter has the advantage of having two distinct cut-off frequencies, this permits the procurement of the desired response curve.

Figure 5:
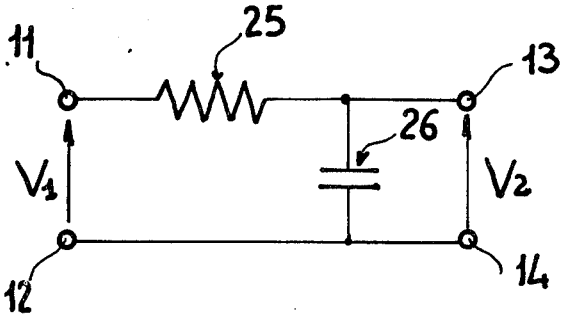

In the different embodiment shown in FIG. 5, the waveform corrector comprises a low pass filter of first order with passive elements. It simply comprises a resistance 25 between the terminals 11 and 13 and a condenser 26 connected shunting the terminals 13 and 14. This filter can be used to obtain an approximation of the curve shown in FIG. 2 or in the case of an association with a mechanical release system already having mechanical damping means.

Figure 6:
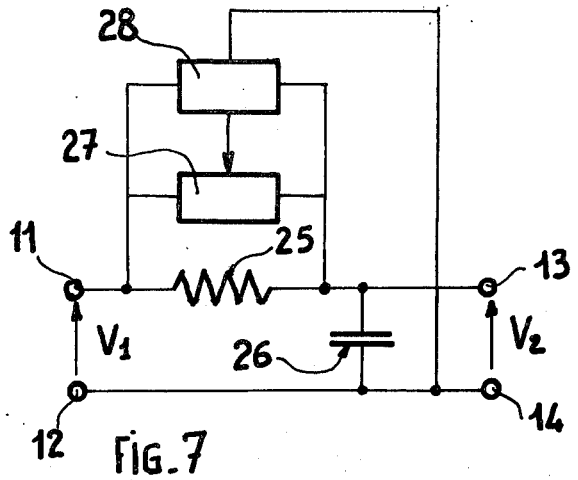

FIG. 6 shows a variation of the filter shown in FIG. 5 in which the filter comprises two elements 27 and 28 connected in parallel across the resistance 25 and in parallel themselves. Moreover, the element 28 is connected to the terminal 14. The element 28 is set to determine if the input signal $V_1$ is greater or lower than the output signal $V_2$ and according to this information it orders the element 27 forming an interrupter. If the signal $V_1$ is greater than the signal $V_2$, the interrupter 27 is open and the filter functions normally. On the contrary, if the signal $V_1$ is lower than the signal $V_2$, the element 28 orders the closure of the interrupter 27 which then short circuits the resistance 25 and takes the signal $V_2$ to the level of signal $V_1$. The element 27 can be constituted by a transistor or a thyristor. The element 27 and the element 28 can also be replaced by a single element such as a diode.

Figure 7:
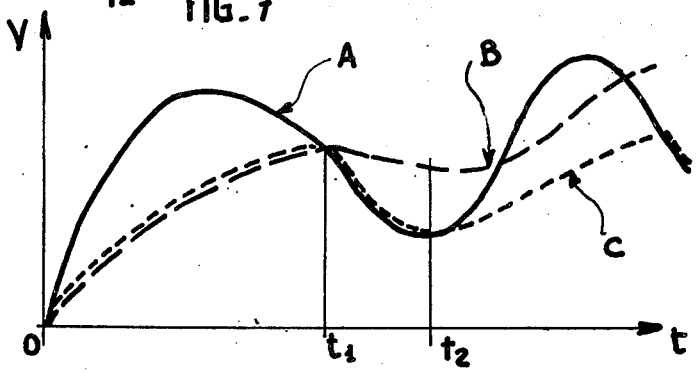
FIG. 7 is a graph showing the result of using a form of the invention as shown in FIG. 6.

FIG. 7 shows the necessity for using a circuit such as is illustrated in FIG. 6. In the graph of FIG. 7 the time t is marked along the abscissa and the signal V is marked along the ordinate. The curve A, in full lines, represents an example of a signal such as would appear at the output of the filter in the absence of the elements 27 and 28, that is to say such as represented in FIG. 5. The curve C, in short dashed lines, represents the corrected signal by the presence of these two elements.

It can be seen on the graph of FIG. 7 that between the time O and the time t1, the signal A is greater than the signal 13, that is to say that the signal $V_1$ is greater than the signal $V_2$ and the filter fulfills its function since the signal $V_2$ is attenuated in relation to the input signal $V_1$. At the time t1, the signal $V_1$ which diminishes following a decrease in the force, becomes lower than the output signal $V_2$ which itself tends normally to continue to increase, following a dephasing introduced by the filter. However, at this instant t1, the element 28 orders the closure of the interrupter 27 which thus ensures the short circuitry of the resistances 25. This being accomplished, the output voltage $V_2$ becomes equal to the input voltage $V_1$ and decreases this latter, following the curve C.

When the input voltage $V_1$ begins to increase afresh and becomes once more greater than the output voltage $V_2$, the element 28 opens the interrupter 27 which occurs at the time t2 on FIG. 7. From this moment onwards, the input voltage $V_1$ rises quickly, following a new significant force exerted by the binding, but on the contrary the output voltage $V_2$ follows the curve C and rises very slowly. The filter functions afresh and assumes its attenuating function.

If the elements 27 and 28 are not provided, the dephasing introducing by the filter causes the inconvenience of untimely release, after the time t, because the output voltage $V_2$ follows the curve B and continues to rise, while the input voltage $V_1$ (curve A), that is to say the force on the binding has already diminished and has not been dangerous to the skier's leg due to the short duration of its application.

Figure 8:
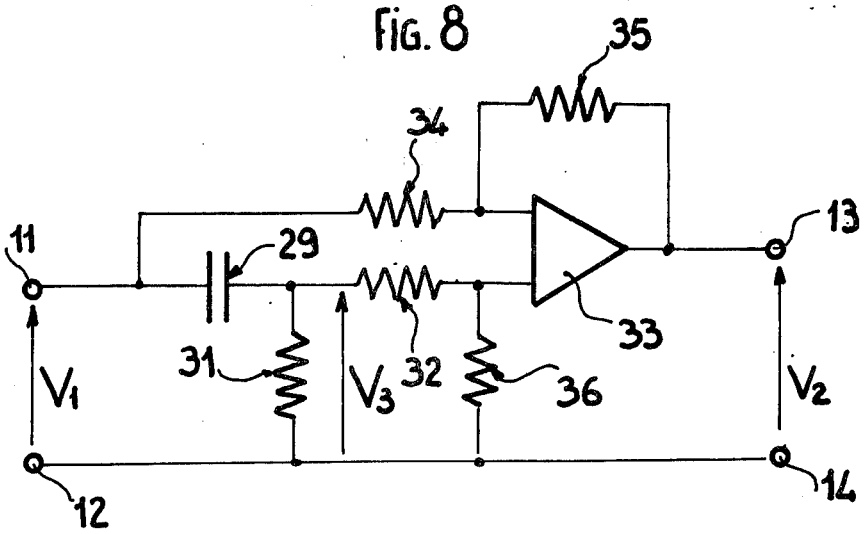
FIGS. 8 and 9 are electrical circuit diagrams of other forms of waveform correction circuits.

In the modification of FIG. 8, the waveform corrector is constituted by a passive high-pass filter of the first order associated with a subtraction element. The passive high-pass filter is constituted by a condenser 29 and a resistance 31. The condenser 29 is connected, on the one hand, to the input terminal 11 and, on the other hand, through the intermediary of a resistance 32 to an input of an operational amplifier 33. The terminal 11 is also connected through the intermediary of another resistance 34 to the second input of the operational amplifier which is connected to the output of the latter by a resistance 35. A resistance 36 is connected between the first input of the amplifier and the two terminals 12 and 14.

The resistances 32, 34, 35 and 36 determine the increase in voltage at this stage.

If V3 is the output voltage of the high-pass filter constituted by elements 29 and 31, the subtraction element comprising the operational differential amplifier delivers an output voltage V2 equal to the difference V1–V3. Below the cut-off frequency fo of the high-pass filter, the output tension V3 is nil and in this case the output tension V2 of the circuit is equal to the input voltage V1. On the contrary, above the cut-off frequency of the filter an output voltage V3 appears, this voltage being proportional to the amplitude and duration of the input voltage V1. The output signal V2 is thus attenuated proportional to the amplitude and duration of the input voltage V1.

A passive high-pass filter of the second order can be used or alternatively an active high-pass filter of the first or second orders.

All the embodiments of the invention previously described use amplifiers and RC elements (resistance, condenser). However, without departing from the scope of the invention, one could also use RL elements (resistance, inductance) or RLC elements (resistance, inductance and condenser) or even LC (inductance condenser).

In these ways of realising the invention, one uses either a single filter (alone or complementing a mechanical system) or two filters in cascade to obtain a better adapted response curve. It is evident that one could also provide an arrangement in series or parallel of a greater number of these filters to obtain different response curves. For example, if one wishes to attenuate or suppress all the high frequencies, one can intercalate one or more filters of the nth order which serve to eliminate or to attenuate the desired frequencies.

One can provide a filter with one or more pick-ups intercalating in the circuit, before the filter, a summing element to sum all the received signals.

Figure 9:
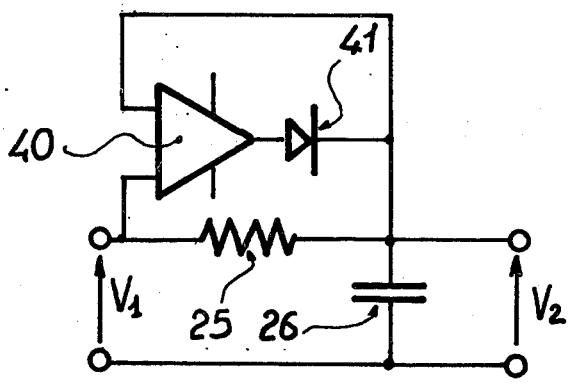

FIG. 9 is a modification of the circuit of FIG. 6 which permits understanding of what has been described with reference to FIG. 7. In FIG. 9, an operational amplifier 40 connected in series with a diode 41 is connected in parallel with the resistance 25 in place of elements 27, 28 of the circuit of FIG. 6. The arrangement of operational amplifier 40 and diode 41 thus constitutes an ideal diode and is equivalent to elements 27 and 28.

What is claimed is:

1. A ski safety binding, said binding having an electric release, comprising: at least one boot clamping member on the ski; locking means for locking said member; a release control circuit acting on said locking means, defining means for detecting a force exercised on a skier's leg and thereafter producing an electric signal as a function of said force; threshold circuit means and means electrically controlling said locking means to effect release of said binding in response to an output of said threshold circuit, said detecting means in circuit relation to said threshold circuit, and low-pass filter circuit means interposed between said detecting means and said threshold circuit, for increasingly attenuating an output electrical signal in response to the duration of said signal coming from said detecting means which substantially follows a hyperbolic function, wherein: the attenuating circuit comprises means for suppressing the filter when the signal received becomes in value equal to the filtered signal and is defined by an arrangement formed by an operational amplifier and a diode in series, said arrangement being connected in parallel with a filter resistance.

2. A ski safety binding, said binding having an electric release, comprising: at least one boot clamping member on the ski; locking means for locking said member; a release control circuit acting on said locking means, defining means for detecting a force exercised on a skier's leg and thereafter producing an electric signal as a function of said force; threshold circuit means and means electrically controlling said locking mans to effect release of said binding in response to an output of said threshold circuit, said detecting means in circuit relation to said threshold circuit, and low-pass filter circuit means interposed between said detecting means and said threshold circuit for increasingly attenuating an output electrical signal responsive to the shortness of signal duration coming from said detecting means substantially following a hyperbolic function; said low pass filter circuit means being comprised of passive elements and two supplementary elements, whereof one is an interrupter short circuiting one of the passive elements, while the other element compares the input and output voltages of the filter to open the interrupter where the input voltage is higher than the output voltage and to close the interrupter when the opposite condition occurs.

3. A ski safety binding, said binding having an electric release, comprising: at least one boot clamping member on the ski; locking means for locking said member; a release control circuit acting on said locking means, defining means for detecting a force exercised on a skier's leg and thereafter producing an electric signal as a function of said force; threshold circuit means and means electrically controlling said locking means to effect release to said binding in response to an output of said threshold circuit, said detecting means in circuit relation to said threshold circuit, and an attenuating circuit interposed between said detecting means and said threshold circuit for increasingly attenuating an output electrical signal in response to the shortness of signal duration coming from said detecting means substantially following a hyperbolic function; comprising a high-pass filter associated with a subtraction system causing a difference between respective input and output voltages of said high-pass filter and delivering an output voltage corresponding to an attenuated signal.

4. A ski safety binding according to claim 3, wherein: the subtraction system comprises an operational differential amplifier with two terminals to which are respectively applied the input voltage and output voltage of the high-pass filter.

5. A ski safety binding, said binding having an electric release, comprising: at least one boot clamping member on the ski; locking means for locking said member; a release control circuit acting on said locking means, defining means for detecting a force exercised on a skier's leg and thereafter producing an electric signal as a function of said force; threshold circuit means and means electrically controlling said locking means to effect release of said binding in response to an output of said threshold circuit, said detecting means in circuit relation to said threshold circuit, and a low-pass filter circuit means interposed between said detecting means and said threshold circuit for increasingly attenuating an output electric signal in response to the shortness of signal duration coming from said detecting means substantially following a hyperbolic signal; and being further defined by means of suppressing the filter when a signal received is of a value equal to the filtered signal.

* * * * *